United States Patent [19]

Otsuka et al.

[11] Patent Number: 5,001,027

[45] Date of Patent: Mar. 19, 1991

[54] ELECTROPHOTOGRAPHIC APPARATUS AND METHOD

[75] Inventors: Shigenori Otsuka, Omiya; Itaru Ogawa, Yokohama; Kazuyuki Mito, Machida, all of Japan

[73] Assignee: Mitsubishi Kasei Corporation, Tokyo, Japan

[21] Appl. No.: 362,499

[22] Filed: Jun. 7, 1989

[30] Foreign Application Priority Data

Jun. 9, 1988 [JP] Japan ..... 63-142418

[51] Int. Cl.[5] ..... G03G 13/00

[52] U.S. Cl. ..... 430/31; 430/494; 430/58; 355/219

[58] Field of Search ..... 430/58, 19, 31, 494; 355/219

[56] References Cited

U.S. PATENT DOCUMENTS

| | | | |
|---|---|---|---|
| 4,035,750 | 7/1977 | Staudenmayer | 355/200 |
| 4,197,121 | 4/1980 | Eckenbach | 430/89 |
| 4,609,605 | 9/1986 | Lees et al. | 430/58 |
| 4,841,328 | 6/1989 | Takeuchi et al. | 430/58 X |

OTHER PUBLICATIONS

Nelson, Infrared Light Bias to Eliminate Residual Potentials in Selenium-arsenic Alloy Photoreceptors, Xerox Disclosure Journal, 3:401 (Nov./Dec. 1978).

Kitayama, abstract to Japanese application No. 59-33641.

*Primary Examiner*—David Welsh

*Attorney, Agent, or Firm*—David G. Conlin; Peter F. Corless

[57] ABSTRACT

Disclosed herein is an electrophotographic apparatus and method which repeatedly use an electrophotographic photoreceptor having on an electroconductive support a photosensitive layer formed by dispersing a charge-generating substance in a binder containing a charge-transporting substance and a binder resin and a means or step for optically erasing the residual charges on the photoreceptor after transfer, the main component of a light used in the means for optically erasing the residual charges having the wavelength range which satisfies the condition defined in the formula (1):

$$l/d \leqq 0.5 \quad (1)$$

ps wherein l is the distance of penetration of the light, i.e. the distance in the direction of depth in which the light incident on the photosensitive layer is attenuated to one tenth in intensity, and d is the thickness of the photosensitive layer.

7 Claims, 3 Drawing Sheets

ELECTROPHOTOGRAPHIC APPARATUS AND METHOD

FIELD OF THE INVENTION

The present invention relates to an electrophotographic apparatus and method for the repeated use of an electrophotographic photoreceptor having a photosensitive layer formed by dispersing a charge-generating substance in a binder containing a charge-transporting substance and a binder resin. More particularly, the present invention relates to an electrophotographic apparatus and method which includes the improved means (or step) for optically erasing the residual charges on the photoreceptor after transfer so as to keep the electric properties of the photoreceptor even if the photoreceptor is repeatedly used.

BACKGROUND OF THE INVENTION

Electrophotographic process in which the photoreceptor is repeatedly used has been applied to various business and office machines such as copying machines, output printers for computers and word processors because it is possible to use plain paper and obtain high density clear images.

As the photoreceptors used in such an electrophotographic process, inorganic photoconductors such as Se, CdS have been used. Recently, organic photoconductors have been developed and widely used.

On the other hand, with respect to the structures of the photoreceptors, a laminated photoreceptor which has an electroconductive support on which a charge-generating layer and a charge-transporting layer are laminated in that order is interested in because of their excellent sensitivity, durability and productivity as well as no pollution.

In the electrophotographic process using the laminated photoreceptor, the photoreceptor should be negatively charged since the charge-transporting layer in the photoreceptor usually comprises a hole transport substance. The electrophotographic process using the negatively charged photoreceptor is disadvantageous as compared with the positively charged electrophotographic process. Because, it is necessary in the former process to use a negative corona charger which accompanies the production of much ozone and to use a positive toner with poor durability. Thus, the positively charged electrophotographic process with no use of the laminated photoreceptor is desired.

Further, it is difficult and troublesome to prepare the laminated photoreceptor because the charge-generating layer should be formed with a thin and uniform thickness and a large area and the combinations of raw materials of which both layers consist are limited. In this regard, the electrophotographic process with no use of the laminated photoreceptor is strongly desired.

As the photoreceptor other than the laminated photoreceptor, a photoreceptor comprising a photosensitive layer which is formed by dispersing a particulate charge-generating substance in a binder containing a charge-transporting substance and a binder resin has been known. In the use of this dispersed photoreceptor, the above-mentioned problems concerning the use of the laminated photoreceptor can be resolved because it is possible to be positively charged and to prepare as the monolayer in principle. Especially, the dispersed photoreceptor containing the dispersed particles of the charge-generating substance in the relatively small amount was found to have the improved electric properties and little fatigue.

When the dispersed photoreceptor is repeatedly used in the electrophotographic process, however, it offers a problem such as change in charged voltage and lowering in sensitivity. Particularly when the dispersed photoreceptor is repeatedly used in the electrophorographic process including the means (or step) for optically erasing the residual charges on the photoreceptor after transfer, the above problem is important.

In the electrophotographic process using the laminated photoreceptor, as the light for erasing the residual charges the light which won't be absorbed in the charge-transporting layer is generally used. A light of relatively long wavelength such as tungsten lamp filtered to eliminate the shorter wavelength light and red light are often used. When such a light of relatively long wavelength is applied in the electrophotographic process using the laminated photoreceptor, the electrical fatigue such as the change of the sensitivity and the charged voltage of the photoreceptor can be minimized in its repeated use. However, if the same light is applied in the electrophotographic process using the dispersed photoreceptor, the decrease of the sensitivity and sometimes the raise of the charged voltage of the photoreceptor in its repeated use were observed.

The present inventors have investigated the stabilization of the properties of the dispersed photoreceptor in its repeated use and as the result, they discovered that the properties of the dispersed photoreceptor can be stabilized or kept when a light in the specified wavelength, which is strongly absorbed in the photosensitive layer and is small in distance of penetration into the photosensitive layer is used as the light for optically erasing the residual charges (hereinafter referred to as "charge erasing light") in the electrophotographic process.

SUMMARY OF THE INVENTION

Thus, in a first aspect of the present invention, there is provided an electrophotographic apparatus which comprises an electrophotographic photoreceptor having on an electroconductive support a photosensitive layer formed by dispersing a charge-generating substance in a binder containing a charge-transporting substance and a binder resin, means for electrically charging the photoreceptor, a light source for effecting image exposure to the surface of the charged photoreceptor, means for developing the image-exposed surface of the photoreceptor, means for transferring the developed image on the photoreceptor onto a recoding medium, and a means for optically erasing the residual charges on the photoreceptor after transfer, the main component of a light used in the means for optically erasing the residual charges having the wavelength range which satisfies the condition defined by the following formula (1):

$$l/d \leqq 0.5 \quad (1)$$

wherein l is the distance of penetraion depth of the light, i.e. the distance in the direction of depth in which the light incident on the photosensitive layer is attenuated to one tenth in intensity and d is the thickness of the photosensitive layer.

In a second aspect of the present invention, there is provided an electrophotographic method which repeatedly use an electrophotographic photoreceptor having on an electroconductive support a photosensitive layer formed by dispersing a charge-generating substance in a binder containing a charge-transporting substance and a binder resin and which includes the step for optically erasing the residual charges on the photoreceptor, the main component of a light for optically erasing the residual charges having the wavelength range which satisfies the condition defined by the above formula (1).

DETAILED DESCRIPTION OF THE INVENTION

Figure 1:
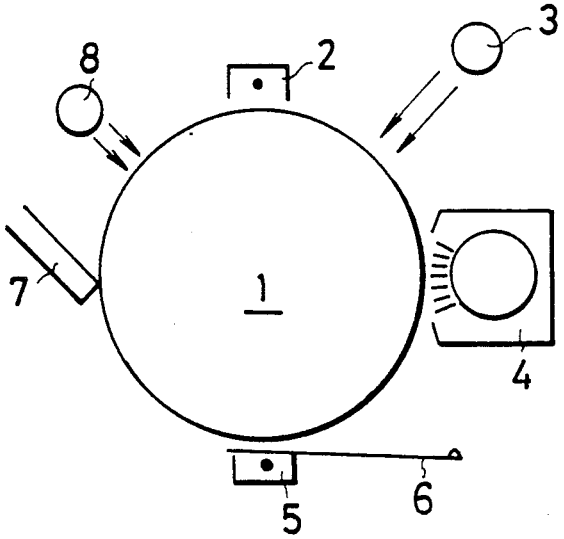
FIG. 1 is a shematic illustration showing an embodiment of the electrophotographic process according to the present invention.

An embodiment of the electrophotographic method using the apparatus according to the present invention is illustrated in FIG. 1.

Referring to FIG. 1, 1 is the electrophotographic photoreceptor comprising a drum on which a photosensitive layer is provided. The photoreceptor is charged by a corona charger 2. As the drum turns, its surface is then subjected to image exposure by a light from a light source 3 and the image is developed and visualized by a developing unit 4. Then, the toner image is transferred to a receiving material 6, such as paper. After transfer, the residual toner is scraped out by a blade cleaner 7. As the drum surface is thus cleaned, the residual charges are erased by the light from a unit for optically erasing the residual charges 8. This completes the first cycle of the electrophotographic process and the same cycle is repeated.

The charge erasing light comprises the main component having the wavelength range which satisfy the condition defined by the formula (1). The distance of light (l) is determined as follows.

Firstly, the photosensitive layer is formed on the transparent substrate such as glass or polyester film. The absorption spectrum of the photosensitive layer is determined with a commercially available spectrophotometer so as to calculate the absorbance $\alpha$ per unit thickness.

When the light with an intensity $I_0$, which is incident on the material with an absorbance $\alpha$ advances through a distance x into the material from its surface, the light intensity is attenuated due to the absorption by the material according to the following relation:

$$I = I_0 10^{-\alpha x}$$

The distance x at which I becomes 1/10 of $I_0$ is defined as the distance of penetraion (l). The value (l) will vary depending on the composition of the photosesitive layer.

As mentioned above, the main component of the charge erasing light should have the wavelength range which satisfies the above condition. Preferably, 80% or more of the all lights contributing to erase the residual charges has the wavelength range which satisfies the above condition.

The charge erasing light may include the additional lights which do not substantially contribute to erase the residual charges, that is, the lights which the photosensitive layer does not absorb or shows no sensitivity even if absorbing it. Such lights include the light of the wavelength showing a half-light decay exposure of more than about 100 times that of the light of a specific wavelength with the smallest half-light decay exposure.

A variety of known methods and light sources may be used for obtaining the charge erasing light which satisfies the above condition. In case of using a light source having a spectrum over the wide wavelength range such as tungsten lamp and white fluorescent lamp, it is recommended to use a color filter to eliminate unnecessary wavelength components. In case of using a light source having a relatively narrow emission distribution such as light-emitting diode and EL lamp, it is possible to select the material having the emission spectrum which satisfies the above condition with no need of using any filter.

Likewise, fluorescent lamps of specific colors and various discharge tubes can be used.

The photoreceptor used in the present invention has on the electroconductive support a photosensitive layer. As the support, it is possible to use, for example, a drum or sheet made of metal such as aluminium, copper and the like.

The photosensitive layer in the photoreceptor of the present invention is formed by dispersing the charge-generating substance in the binder containing the charge-transporting substance and the binder resin. The charge-generating substance usable in the present invention includes inorganic photoconductors such as Se, Se-Te alloy, $As_2$-$Se_3$ alloy, CdS and amorphous silicon, and organic photoconductors such as azo pigment, phthalocyanine pigment, perylene pigment, polycyclic quinone pigment, quinacridone pigment, indigo pigment and squarilium salt. The charge-generating substance is preferably dispersed as the finely divided particles in the photosensitive layer. It is desirable that the particles of the charge-generating substance have very small particle size, for example particle size of less than 1 micrometer, preferably less than 0.5 micrometer. Too small an amount of the charge-generating substance dispersed in the photosensitive layer makes it unable to obtain the photoreceptor having the sufficient sensitivity, while too great an amount tends to increase the fatigue of the photoreceptor. Thus, the preferred amount of the charge-generating substance is 0.5 to 40% by weight, more preferably 1 to 20% by weight.

The binder in the photoreceptor of the present invention comprises the charge transporting substance and the binder resin. The ratio of the charge-transporting substance to the binder resin is not particularly limited, but it is preferable to add 20 to 200 parts by weight, preferably 50 to 150 parts by weight of the charge-transporting substance to 100 parts by weight of the binder resin.

The charge-transporting substance usable in the present invention includes a variety of known organic materials. Examples of such materials are heterocyclic compounds such as carbazole, indole, imidazole, thiazole, oxadiazole, pyrazole and pyrazoline; and electron donative materials such as aniline derivatives, hydrazine derivatives, hydrazone derivatives, stilbene derivatives and polymers having the groups consisting of said compound in the main or side chains. Among them, the hydrazone derivatives, the aniline derivatives and the stilbene derivatives are preferred.

The binder resin usable in the present invention includes various type of known materials. Examples of such materials are acrylic resin, methacrylic resin, polystyrene regin, vinyl chloride resin, phenoxy resin, polyester resin, polycarbonate resin and their copolymers. Among them, the polycarbonate resin and polyester resin are preferred.

The photosensitive layer of the present invention may contain known additives. The photosensitive layer may have a protective layer on its surface. Further, additional layers such as a barrier layer may be provided between the support and the photosensitive layer.

As the charging means usable in the present invention, there can be used, for example, a corona charger utilizing corona discharge ions such as corotrone and scorotrone and a contact charging means using an electroconductive roller or brush to which a bias voltage is applied.

For the image exposure in the present invention, the following methods are usable:

the reflected light from the original is exposed by original-scanning illumination through an optical system;

the original is irradiated over its entire surface with flush light while the surface of the photoreceptor is illuminated simultaneously;

the laser beams modulated as picture information are scanned by digital signals; and the exposure is effected by light from an array-like light source such as luminophor array or light shutter array.

As the developing means usable in the present invention, there can be used, for example, a two component magnetic brush, an one component magnetic toner, an one component non-magnetic toner and a liquid toner.

As the transfer means usable in the present invention, there can be used, for example, a method in which the back side of the transfer material is corona charged or a method in which bias rolls are applied to the backside of the transfer material.

As the cleaning means usable in the present invention, there can be used, for example, a blade cleaning method using an elastic scraper blade, a brush cleaning method and a magnetic brush cleaning method.

According to the present invention wherein as the light for erasing the residual charges the light has the wavelength range which satisfies the condition defined by the formula (1), the dispersed photoreceptor can be repeatedly used while keeping the electric properties and the sensitivity without showing little fatigue, as shown in the following example.

EXAMPLE

The following example will more fully illustrate the embodiment of the present invention.

EXAMPLE

Cyclohexanone was added to 5 parts by weight of a bisazo compound having the following structure and mixed by a sand grind mill so as to obtain a preliminary dispersion.

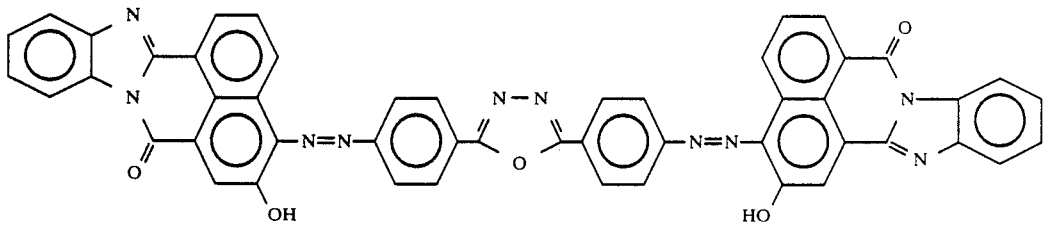

While, 50 parts by weight of a hydrazone compound having the following structure and 50 parts by weight of bisphenol Z polycarbonate resin were dissolved in cyclohexanone, which was mixed with the above preliminary dispersion by a sand grind mill so as to obtain a coating solution.

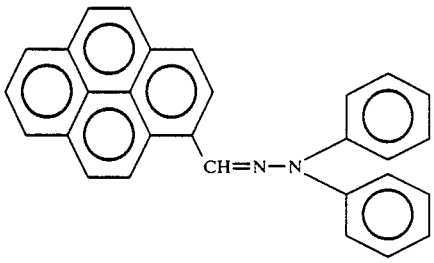

This coating solution was spray-coated on an aluminium cylinder and dried to obtain a photoreceptor having a photosensitive layer with 20 micrometers thicknes.

Figure 2:
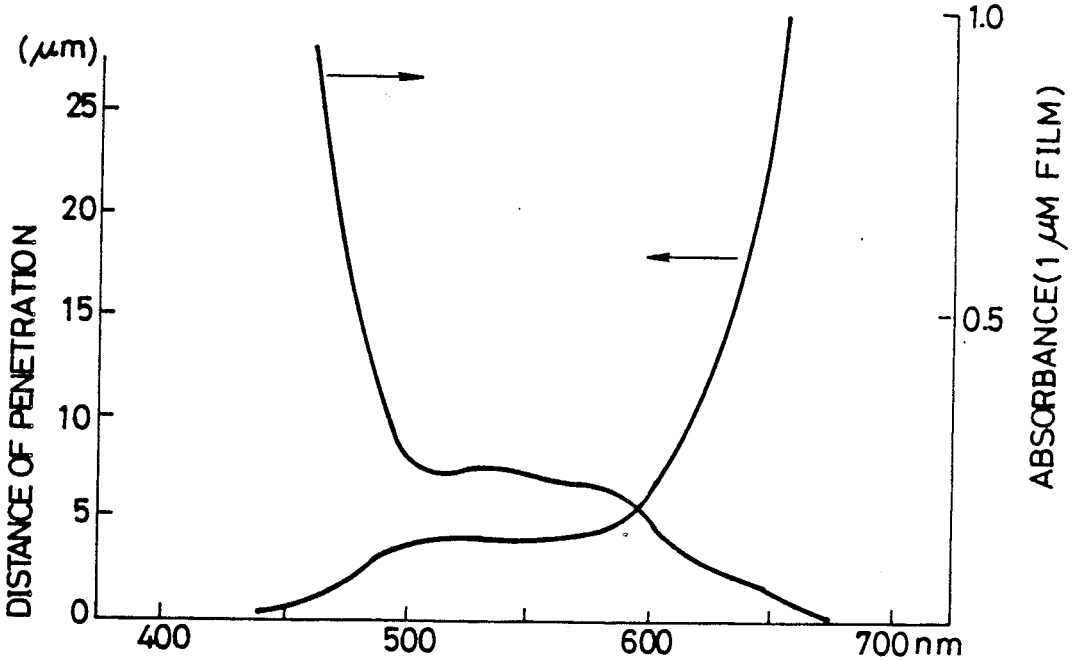
FIG. 2 is a graph showing the spectral changes of absorbance and the distance of penetration of the light in the photosensitive layer used in Example.

For determining the distance of penetration of the light into the photosensitive layer, the same coating solution was coated on a glass plate to prepare a film with 1 micrometer. The absorption spectrum of the resultant film was determined using the commercial spectrophotmeter to calculate the absorbance. Further, the distance of penetration was calculated from the absosrbance. From the results as shown in FIG. 2, it was found that the light with short wavelength of less than 600 nm can satisfy the condition defined by the formula (1).

The above photoreceptor was used in the electrophotographic apparatus as shown in FIG. 1. For determining the changes of electric properties of the photoreceptor in its repeated use, this photoreceptor was repeatedly subjected to the electrophotographic cycle including charging, image-exposure and charge-erasing, provided that development, transfer and cleaning were omitted. As the charge erasing light, there was used the light, the main component of which has the wavelength of 400 to 600 nm and which was obtaind from a white tungsten lamp through a green filter with transmittance shown in FIG. 3.

Figure 4:
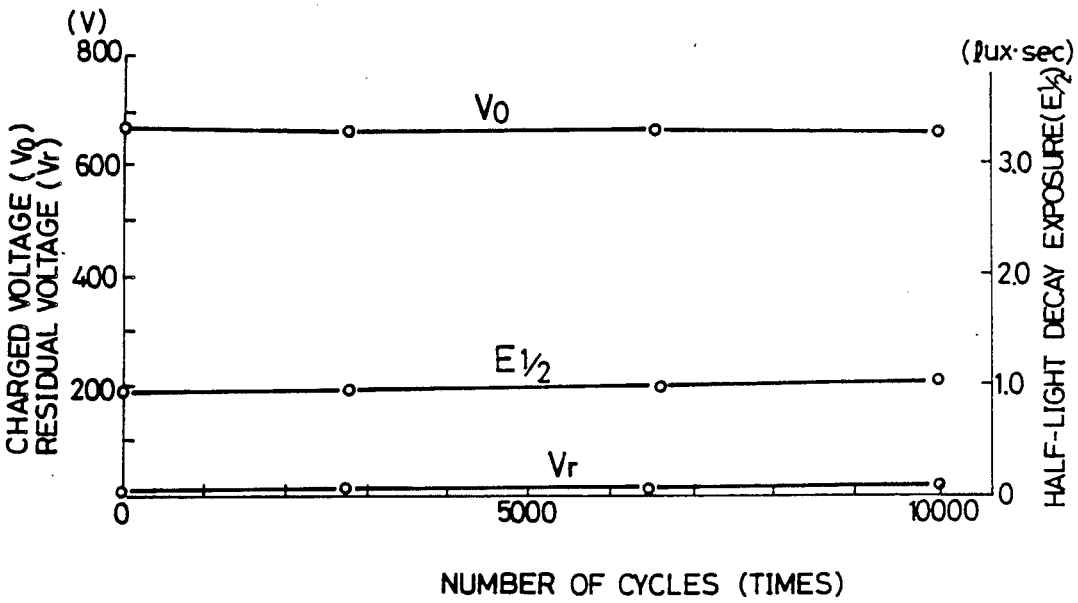
FIG. 4 shows the test results obtained by repeating the electrophotographic cycle of Example.

As clear from the results shown in FIG. 4, the charged voltage ($V_o$). the residual voltage ($V_r$) and the half-light decay exposure ($E_{1/2}$) were substantially kept after the photoreceptore was subjected to 10,000 electrophotographic cycles. It is clear that there were no change in the sensitivity and little fatigue of the photoreceptor.

COMPARATIVE EXAMPLE 1

Figure 3:
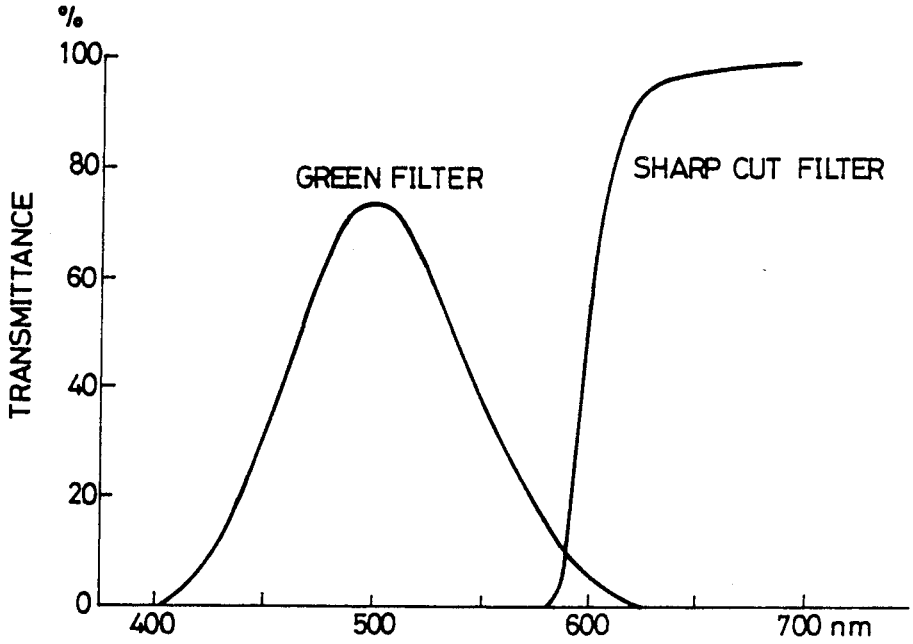
FIG. 3 is a graph showing the relation of transmittance with wavelength of the filters used in Example and Comparative Example 1.

The above example was repeated As the charge erasing light, there was used the light, the main component of which has the long wavelength of 600 nm or more and which was obtaind from a white tungsten lamp through a sharp cut filter with transmittance shown in FIG. 3.

Figure 5:
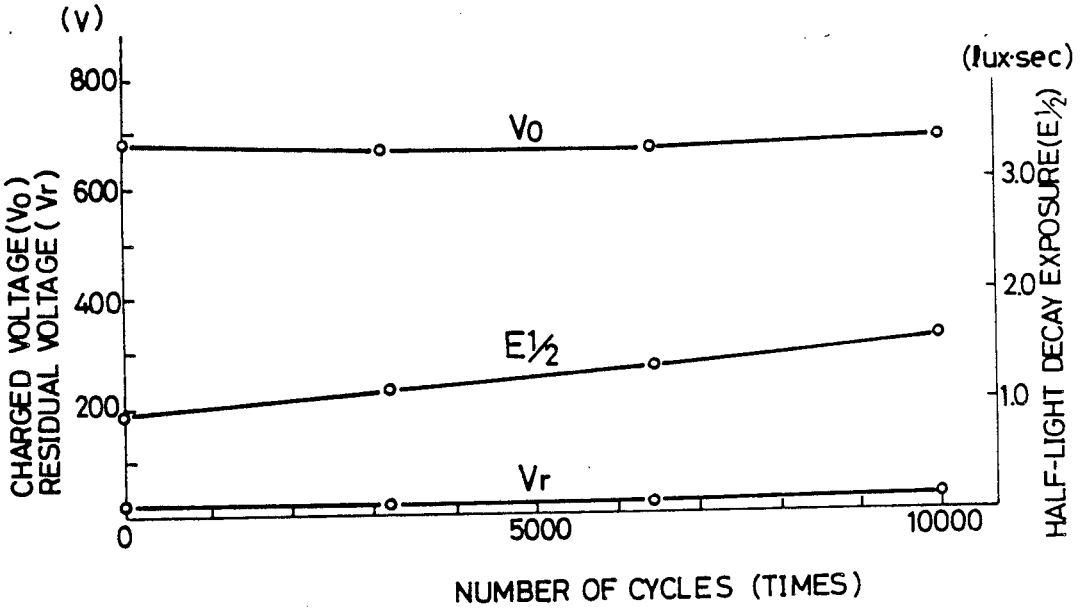
FIG. 5 shows the test results obtained by repeating the electrophotographic cycle of Comparative Example 1.

As clear from the results shown in FIG. 5, the half-light decay exposure ($E_{1/2}$) was remarkably increased after the photoreceptor was subjected to 10,000 electrophotographic cycles. It is clear that the sensitivity of the photoreceptor was not kept if the light which does not satisfy the condition defined by the formula (1) is used.

COMPARATIVE EXAMPLE 2

The above example was repeated. As the charge erasing light, there was used the light from a white tungsten lamp in the absence of any filter.

The initial half-light decay exposure ($E_{1/2}$) was 1.00 lux sec and it was remarkably increased (1.53 lux sec) after the photoreceptor was subjected to 10,000 electrophotographic cycles. It is clear that the sensitivity of the photoreceptor was not kept if the light which does not satisfy the condition defined by the formula (1) is used.

The present invention now being fully described, it will be apparent to those skilled in the art that many changes and modifications can be made thereto without departing from the spirit or scope of the invention as set forth herein.

What is claimed is:

1. An electrophotographic method which repeatedly uses an electrophotographic photoreceptor which have on an electroconductive support a photosensitive layer formed by dispersing a charge-generating substance in a binder containing a charge-transporing substance and a binder resin and which includes the step for optically erasing the residual charges on the photoreceptor after transfer, the main component of a light used for optically erasing the resiudal charges having the wavelength range which satisfies the condition defined in the formula (1):

$$l/d \leqq 0.5 \quad (1)$$

wherein l is the distance of penetration of the light, i.e. the distance in the direction of depth in which the light incident on the photosensitive layer is attenuated to one tenth in intensity, and d is the thickness of the photosensitive layer.

2. A method according to claim 1, wherein as the light for optically erasing the residual charges, there is used a light obtained by eliminating unnecessary wavelength components from a light source having wide wavelength range through a color filter.

3. A method according to claim 1, wherein as the light for optically erasing the residual charges, there is used a light from a light source having an emission spectrum with narrow distribution.

4. A method according to claim 1, wherein the distance of penetration in the formula (1) is 10 micrometers or less.

5. A method according to claim 1, wherein the charge-generating substance in an amount of 1 to 20 perçent by weight is dispersed in the photosensitive layer.

6. A method according to claim 1, wherein the charge-generating substance dispersed in the photosensitive layer is one or more compounds selected from the group consisting of azo pigment, phthalocyanine pigment, perylene pigment, polycyclic quinone pigment, quinacridone pigment, indigo pigment and squarilium salt.

7. A method according to claim 1, wherein the charge-transporting substance in the photosensitive layer is a hydrazone derivative, an aniline derivative or a stilbene derivative.

* * * * *